United States Patent [19]

Tilch et al.

[11] 4,194,752

[45] Mar. 25, 1980

[54] SKATEBOARD

[75] Inventors: Gerhard Tilch; Wolfgang Friedrich, both of Schweinfurt; Herbert Dobhan, Bergrheinfeld; Hermann Hetterich, Heidenfeld; Peter Horling, Mainberg; Sigismund Finzel, Dittelbrunn, all of Fed. Rep. of Germany

[73] Assignee: SKF Kugellagerfabriken GmbH, Schweinfurt, Fed. Rep. of Germany

[21] Appl. No.: 890,519

[22] Filed: Mar. 27, 1978

[30] Foreign Application Priority Data

Jan. 25, 1978 [DE] Fed. Rep. of Germany ..... 7802146

[51] Int. Cl.[2] ..... A63C 17/02

[52] U.S. Cl. ..... 280/11.28; 280/87.04 A

[58] Field of Search ..... 280/11.28, 87.04 A

[56] References Cited

U.S. PATENT DOCUMENTS

| | | | |
|---|---|---|---|
| 2,719,725 | 10/1955 | Ware | 280/11.28 |
| 2,797,926 | 7/1957 | Swensson | 280/11.28 |
| 2,899,209 | 8/1959 | Reynolds et al. | 280/11.28 X |
| 3,104,887 | 9/1963 | Rice et al. | 280/11.28 X |
| 3,862,763 | 1/1975 | Ware | 280/11.28 |
| 4,029,330 | 6/1977 | Runyan | 280/87.04 A |

*Primary Examiner*—Joseph E. Valenza
*Assistant Examiner*—Gene A. Church
*Attorney, Agent, or Firm*—Eugene E. Renz, Jr.

[57] ABSTRACT

A skateboard comprising an elongated board and a pair of trucks mounted adjacent opposite ends of the board, each having a pair of rotatable wheels. Each truck consists of a tensile elastic suspension member and a pivot support consisting of a universally movable ball and socket joint.

1 Claim, 6 Drawing Figures

SKATEBOARD

BACKGROUND OF THE INVENTION

The present invention relates to skateboards and more specifically to one comprising an elongated blank or board and a pair of trucks at opposite ends of the board each supporting a pair of wheels. Each truck is braced directly to the board by means of a hanger plate secured to the board and comprises a tensile elastic suspension section and a pivot support.

As is typical in conventional skateboards, the path of travel of the front and rear wheels and thereby the direction of the skateboard are controlled by the rider's shifting of weight. The skateboard is also at the same time accelerated by weight shifts. Conventional trucks of known design are usually made of a solid, one-piece metallic casting or the like which have the disadvantage of adding weight to the assembly and also are comparatively expensive to manufacture. In these prior skateboard designs, the pivot support for the truck is usually formed by a cylindrically-shaped part which mates with a bore suitably lined with a bearing material, such as plastic, mounted in a hanger plate and is supported in this position by a spherical frontal surface. By this arrangement the truck can only rotate about an axis determined by the shaft of the cylindrical part and this tends to restrict the free adjustability of the wheels. Additionally it has been found that a substantial expenditure of energy is required to steer and accelerate the skateboard. Furthermore in these known skateboard designs, the elastic action bushings are secured by nuts and lock washers which necessitates an inconvenient and time consuming initial tightening adjustment.

With the foregoing in mind, it is an object of the present invention to provide an improved skateboard assembly characterized by novel features of construction and arrangement providing improved steering action of the axles relative to the board and wherein the energy for steering and accelerating the skateboard is substantially reduced.

Another object of the present invention is to provide an improved skateboard design incorporating a novel mounting arrangement for the elastic action bushings providing adjustability of the tension thereof in a more simplified, easier and trouble-free manner.

SUMMARY OF THE INVENTION

According to the present invention the skateboard comprises an elongated board, trucks rotatably supporting a pair of wheels at opposite ends of the board. The trucks are mounted directly on the board or to a hanger plate by at least one tensile elastic element and a pivot support member. In accordance with the present invention the pivot support is a universally movable ball and socket joint. A ball head provided with a pin insertable in a bore in the truck can be used as the ball element and a spherical cup made of a low friction material, e.g. plastic mounted in a bore in the hanger plate or in the board itself can be used as the spherical cup or seat for the ball head. In accordance with another feature of the present invention, the truck is formed by two sheet metal parts. In the preferred embodiment, one of the truck sections is Y-shaped wherein one leg of the Y surrounds the axle and the other truck section is V-shaped and oriented to lie between both of the free legs of the Y-shaped truck section. The ball head of the pivot support is supported in a generally cylindrical pocket formed by one pair of legs of the complementary truck sections.

By reason of the universally movable ball and socket arrangement of the pivot support for bracing the trucks on the board, the truck attains a greater movability with respect to the board providing a pure rolling motion between the ball head and the spherical cup. In this manner the expenditure of energy needed to deflect the wheels is smaller so that even with a small shift in body weight, the wheels are deflected to change the direction of the skateboard. In like manner, less energy is needed to create a greater thrust to accelerate the skateboard. It is therefore possible to design the parts of the ball and socket joint integral with the connecting parts or separate from them.

Furthermore by designing the truck from sheet metal plate sections, a lighter construction is achieved which is simpler and more economical to manufacture and also has the added advantage of reduction in weight of the overall assembly and thus the masses to be accelerated are reduced. As noted above a ball head provided with a pin can be pressed by a friction fit into a recess or pocket formed by the adjoining, confronting legs of the truck sections.

The king pin or bolt assembly for mounting the elastic elements includes a nut to secure the king pin to the board or hanger plate and a nut engaging threads on the outer terminal end of the king pin remote from the head which provides a simple means for adjusting the tension of the elastic elements.

Another feature of the assembly of the present invention is the provision of elongated holes or openings in the baseplate running parallel to the longitudinal axis of the board for securing the baseplate to the board and providing a degree of adjustability to vary the distance between the axles of the front and rear wheels.

These and other objects of the present invention and various features and details and operation and construction thereof are hereinafter more fully set forth with reference to the accompanying drawings.

DESCRIPTION OF PREFERRED EMBODIMENTS

Figure 1:
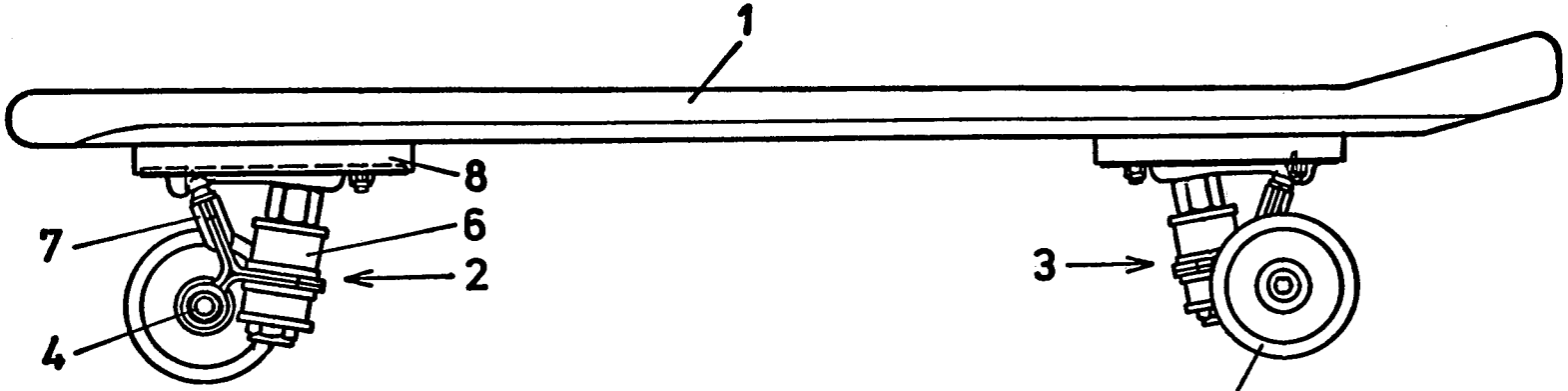
FIG. 1 is a side elevational view of a skateboard constructed in accordance with the present invention.
Figure 2:
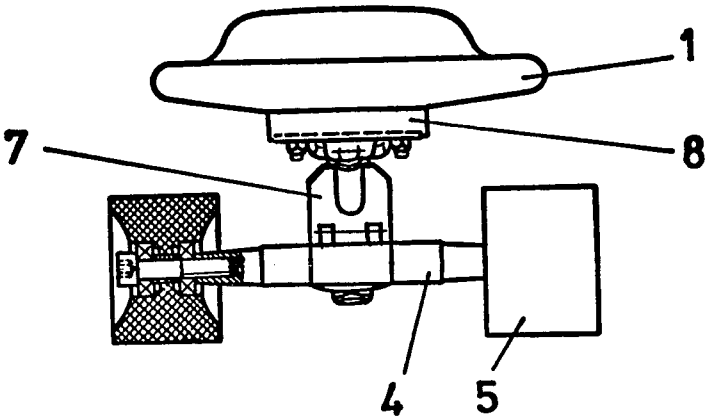
FIG. 2 is a front view of the skateboard with one of the wheels in section to show the mounting of the wheel on the axle.
Figure 4:
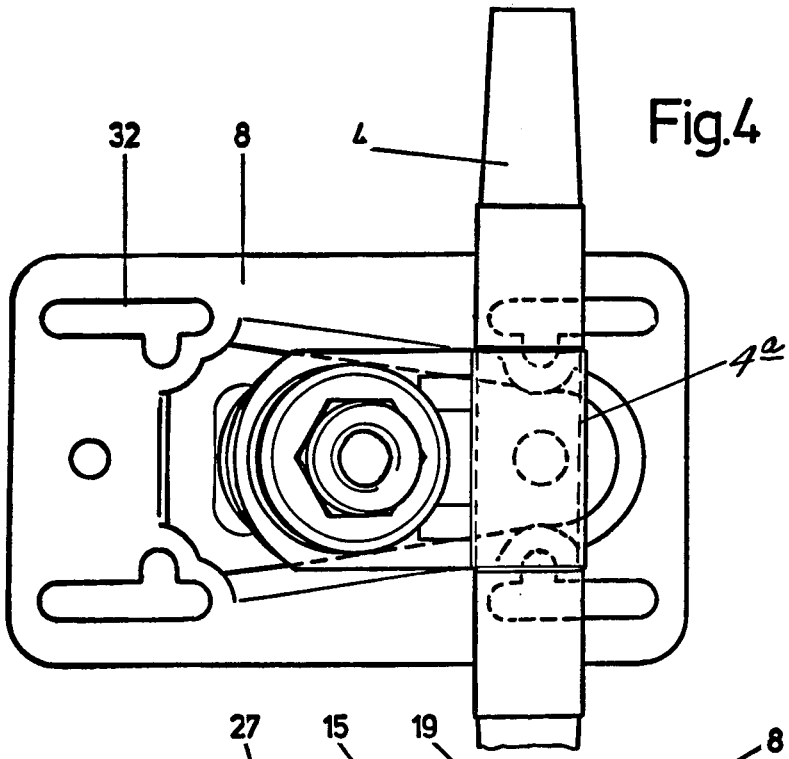
FIG. 4 is a top plan view of the truck.

Referring now to the drawings and particularly to FIGS. 1 - 4 thereof, there is illustrated a skateboard constructed in accordance with the present invention. As illustrated the skateboard comprises an elongated board 1 of generally conventional design, a pair of trucks 2 and 3 mounted on the underside adjacent opposite ends of the board at a distance from one another.

Each truck rotatably supports a pair of wheels 5 journalled on outer terminal ends of a common axle 4. The mounting of the wheels on the axle is by conventional anti-friction bearings. As illustrated each truck is supported on a hanger plate 8 by means of a tensile elastic suspension section 6 and a pivot support 7. The hanger plate 8 in turn is attached to the board by means of nut and bolt fasteners.

Figure 3:
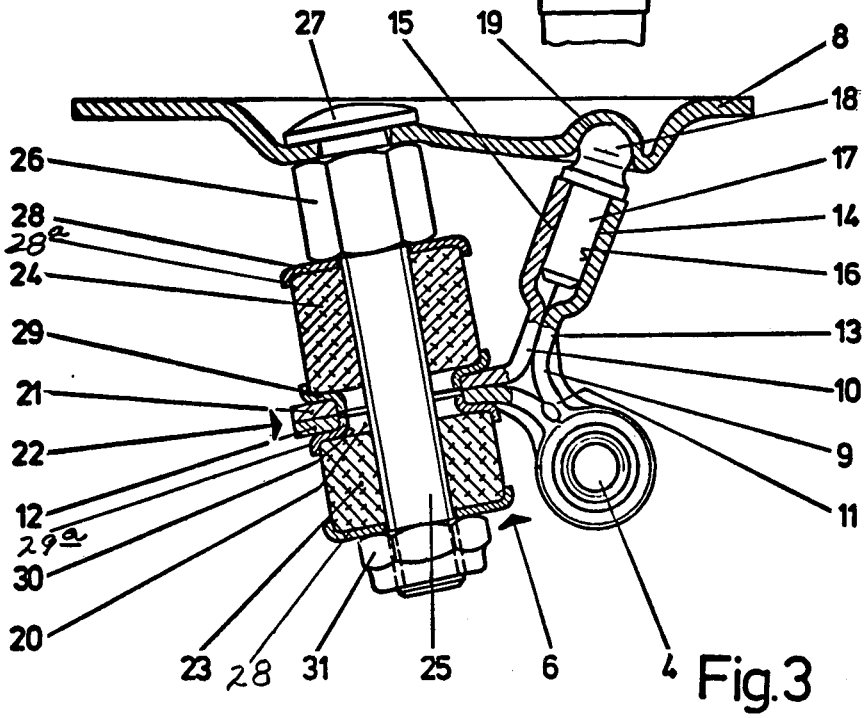
FIG. 3 is an enlarged longitudinal sectional view of the truck assembly.

Considering now the structural details and arrangement of the truck, and with particular reference to FIG. 3, the truck is formed by a pair of complementary truck sections 9 and 10 suitably formed from sheet metal by a conventional stamping operation. The truck section 9 is Y-shaped in cross section and includes an axle support portion 11 formed by the stem of the Y and angularly disposed leg sections 12 and 13. The complementary truck section 10 is V-shaped and of a predetermined configuration to fit and lie between the legs 12 and 13 of the truck section 9. The truck sections 9 and 10 are connected to one another in a suitable manner, for example, by projection welding and may be provided with stiffening ribs, seams or creases. The axle 4 is centered in the axle support portion 11 by means of a circular groove type recess **4*a* in the axle into which the leg 11 engages. The pivot support 7, in the present instance, comprises a ball head 18 having a depending cylindrical pin 17 which seats in a pocket 16 formed by the arcuately shaped projections 14 and 15 in one leg of the truck sections 9 and 10. The ball head engages in a spherical cup 19 formed in the shaped or contoured portion of the base plate 8**.

The tensile elastic suspension section 6 of the truck to brace it to the hanger plate 8 includes an elongated bolt or king pin 25 and a pair of action bushings 23 and 24 made of an elastic material, such as rubber, which circumscribe the king pin in the manner illustrated in FIG. 3. The king pin as illustrated has an enlarged head 27 and a nut 26 to clamp it to the hanger plate. The king pin 25 extends through an opening or bore 20 of a collar arm 22 formed by the leg 12 of the Y-shaped truck section 9 and by the leg 21 of the V-shaped truck section 10. The bushings 23 and 24 are disposed on either side of the collar arm 22 and are encompassed by disc-like washers 28 and 29 having axially projecting peripheral rims or flanges **28*a* and 29*a*. The bushings and washers are supported on the king pin 25 by an adjusting nut 31 threadedly mounted on the outer terminal end of the king pin 25. The washers 29 include an axially projecting circular ring 30 which engages into the bore 20 of the collar arm 22. The positioning of the nut 31 on the king pin determines the axial tension of the action bushings 23 and 24. The maneuverability of the truck can be varied by selectively increasing or decreasing the tension of the bushings through the adjusting nut 31**.

As noted above the hanger plate 8 is secured to the board by means of nut and bolt fasteners or the like. In order to provide means for selectively varying the distance between the trucks, elongated generally oval shaped holes 32 are provided in the hanger plate which extend in a longitudinal direction. This provides a means for shifting the trucks in a direction along the longitudinal plane of the board.

As is best apparent from FIG. 3, the design of the pivot support as a universally movable joint allows for maximum adjustability of the trucks and thereby adjustability of the axle 4 in various directions. This provides for optimum steerability with the least expenditure of energy.

Figure 6:
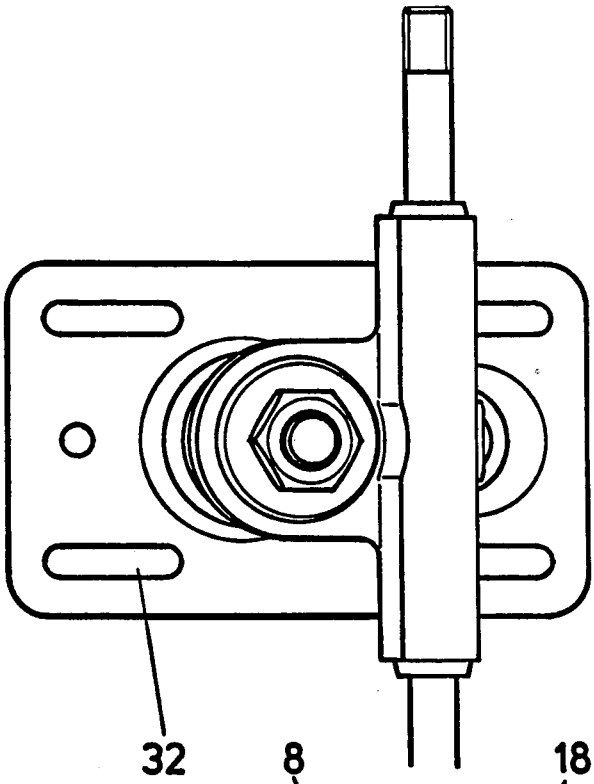
FIG. 6 is a top plan view of the truck assembly shown in FIG. 5
Figure 5:
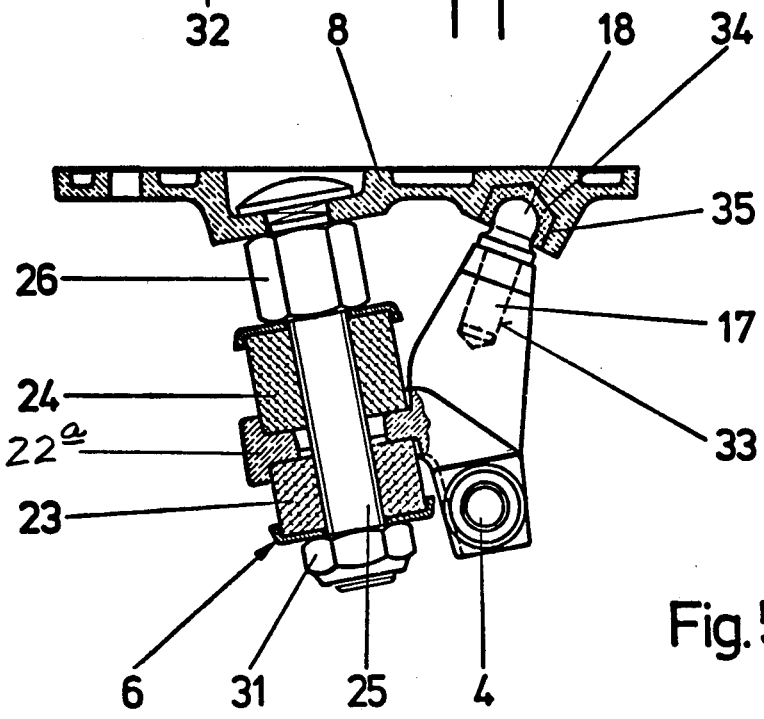
FIG. 5 is a longitudinal sectional view of a modified truck design in accordance with the present invention.

There is illustrated in FIGS. 5 and 6 a modified truck assembly constructed in accordance with the present invention. The general arrangement of the assembly is essentially the same as the previously described embodiment and includes a pivot support 7 and a tensile elastic assembly 6. In the present instance, however, the truck is a one-piece assembly which may be made of a solid metallic material which may be cast or machined. The pivot support includes a ball head 18 which in the present instance seats in a cup 34 mounted in the hanger plate, the cup 34 being formed with a spherical seat to allow universal adjusting pivotal movement of the ball head therein. The ball head has a cylindrical pin which engages in a bore 33 of the pivot support. This design therefore allows the same universal mobility of the truck with respect to the board as in the previously described embodiment. The elastic tension assembly 6 includes a king pin 25 mounted to the hanger plate between its enlarged head and a nut 26. The action bushings 23, 24 circumscribe the king pin 25 and are disposed on opposite sides of a collar arm **22*a* formed integrally with the pivot support. In this instance the inner confronting faces of the action bushings bear directly against the collar arm adjacent the opening for the king pin and outer washers engage between the action bushings and the nut 26 and the adjusting nut 31. The hanger plate is also provided with elongated generally oval-shaped holes 32** for selectively varying the position of the front and rear axles relative to one another.

While particular embodiments of the invention have been illustrated and described herein, it is not intended to limit the invention and changes and modifications may be made therein within the scope of the following claims.

We claim:

1. A skateboard comprising an elongated board, a pair of trucks mounted to said board adjacent opposite ends thereof, each truck having a pair of rotatable wheels, said truck comprising a tensile elastic suspension assembly and a pivot support member, said pivot support member consisting of a universally moveble ball and socket joint, said truck formed by a pair of complementary truck sections formed of sheet metal, one of said truck sections being of Y-shaped cross section and including an axle support portion formed by the stem of the Y and angularly disposed leg sections, a second complementary truck section of V-shaped cross section and of a predetermined configuration to fit and lie between the legs of said first truck section, said truck sections being connected by welding and being provided with stiffening ribs, means defining a groove-type recess in said axle within which the legs of the second truck section engage thereby to center the axle in the axle support portion, said pivot support comprising a ball head having a depending cylindrical pin which seats in a pocket formed by the arcuately shaped projections in one leg of the first and second truck sections, said ball head engaging a spherical cup formed in a complementary shaped portion of the base plate.

* * * * *